US006749239B2

(12) United States Patent
Choi

(10) Patent No.: US 6,749,239 B2
(45) Date of Patent: Jun. 15, 2004

(54) CHOPSTICK MANIPULATOR

(76) Inventor: Joon T. Choi, 970 S. Ardmore Ave., #201, Los Angeles, CA (US) 90006

( * ) Notice: Subject to any disclaimer, the term of this patent is extended or adjusted under 35 U.S.C. 154(b) by 0 days.

(21) Appl. No.: 10/248,915

(22) Filed: Feb. 28, 2003

(65) Prior Publication Data

US 2003/0197390 A1 Oct. 23, 2003

Related U.S. Application Data

(63) Continuation-in-part of application No. 10/125,667, filed on Apr. 18, 2002, now abandoned.

(51) Int. Cl.[7] ..... A47G 21/10
(52) U.S. Cl. ..... 294/99.2; 294/1.1
(58) Field of Search ..... 294/1.1, 3, 8.5, 294/33, 99.2, 16; D7/642–644, 648, 686

(56) References Cited

U.S. PATENT DOCUMENTS

| | | | | | |
|---|---|---|---|---|---|
| 2,711,339 | A | * | 6/1955 | McGogy | 294/99.2 |
| 3,186,749 | A | * | 6/1965 | Dawes | 294/99.2 |
| 3,239,262 | A | * | 3/1966 | Rines et al. | 294/99.2 |
| 3,637,248 | A | * | 1/1972 | Miyoichi | 294/99.2 |
| 4,721,334 | A | * | 1/1988 | Nakatsu | 294/99.2 |
| 5,486,029 | A | * | 1/1996 | Kobayashi | 294/99.2 |
| 5,611,586 | A | | 3/1997 | Kang | |
| 5,810,411 | A | | 9/1998 | Major | |

FOREIGN PATENT DOCUMENTS

| | | | |
|---|---|---|---|
| GB | 2281192 | * | 3/1995 |
| GB | 2288320 | * | 10/1995 |
| JP | 405015430 | * | 1/1993 |
| JP | 406342255 | * | 1/1994 |
| JP | 406296541 | * | 10/1994 |
| JP | 410108775 | * | 4/1998 |

* cited by examiner

*Primary Examiner*—Dean J. Kramer
(74) *Attorney, Agent, or Firm*—Park & Sutton LLP; John K. Park

(57) ABSTRACT

A chopstick manipulator comprises a bridge and clamps. Each clamp includes an inner support having an inner surface where an upper half of the inner surface has a mid portion so the bridge interconnects each mid portion thereof, a rear support extending from a rear end of the inner support so that about a right angle is formed by each outer surface of the inner and rear supports, and a distal support extending substantially forward from an outer end of the rear support while forming a substantially prismatic shape. The distal support is defined by an outer surface, a rearward slant surface and a forward slant surface so that a prismatic ridge by the respective slant surfaces approaches the outer surface of the inner support where an angle by the rear support and the rearward slant surface is less than 90 degrees.

14 Claims, 3 Drawing Sheets

CHOPSTICK MANIPULATOR

CROSS REFERENCE TO RELATED APPLICATIONS

This application is a continuation-in-part of U.S. patent application Ser. No. 10/125,667 filed Apr. 18, 2002, now abandoned.

BACKGROUND OF INVENTION

The invention relates to a chopstick holder. More particularly, the present invention relates to an improved chopstick manipulator which facilitates use of chopsticks for those either raised with forks or poor at chopstick manipulation at table.

As is well known, chopsticks are main tools to eat with in most east Asian nations such as China, Japan and Korea. Also an increasing number of people raised with forks or non-chopstick utensils become exposed to chopsticks in most countries other than the chopstick using nations, for example, when they eat in a Chinese restaurant.

The main difference between chopsticks and a fork is that the fork simply requires a simple holding to manipulate whereas the chopsticks demand a proper grip and a finger operation as well as a properly measured holding. Therefore, it takes time to learn to properly use and get used to chopsticks, and many adults as well as children have difficulty when eating with chopsticks. A reason for such a poor chopstick manipulation is a poor grip that leads to a poor catch at food.

A market demand is to enable those poor at chopstick manipulation to easily control chopsticks with no learning time and at a simple format in which chopsticks are quickly installed and adjusted in a chopstick holder.

SUMMARY OF INVENTION

Accordingly, an object of the invention is to provide a chopstick manipulator which enables a chopstick novice to easily manipulate chopsticks by a simple downward press of a users index finger on a selected upper chopstick in a state of conventional holding.

Another object of the present invention is to easily insert chopsticks into clamps of the manipulator by a sidewise push using an elastic construction of the clamps, thereby enhancing usability and product reliability.

To achieve these other objects, the chopstick manipulator according to the present invention comprises chopstick manipulator comprising a bridge, and first and second clamps being symmetric to each other. Each clamp includes an inner support being a plate and having an inner surface. An upper half of the inner surface has a mid portion, wherein the bridge interconnects each mid portion of the inner surfaces of the inner supports. A rear support being another plate and extending from a rear end of the inner support so that about a right angle is formed by each outer surface of the inner and rear supports. A distal support extending substantially forward from an outer end of the rear support while forming a substantially prismatic shape.

In a preferred version, the distal support is defined by an outer surface, a rearward slant surface and a forward slant surface so that a prismatic ridge by the respective slant surfaces approaches the outer surface of the inner support, wherein an angle by the rear support and the rearward slant surface of the distal support is less than 90 degrees. A distance between the inner supports is substantially incremental from top to down, and the bridge is substantially domed and upwardly waved.

The bridge has a thickness and a width, and each inner support is less in thickness than the bridge. Also, the substantially domed bridge is upwardly waved. Preferably, the rearward slant surface is substantially larger in size than the forward slant surface. Each front side end of the inner supports is outwardly tapered to facilitate chopstick clamping by the clamps. Each prismatic ridge is linearly straight or parallel to the corresponding inner support. For a better performance, at least one indentation is formed in and along each prismatic ridge.

The advantages of the present invention are numerous in that: (1) the chopstick holding of the manipulator is implemented by clamps such that chopsticks become inserted by a sidewise elastic push of the chopsticks into the clamps, for example, enabling the user to substantially synchronize the chopstick use with those good at chopstick manipulation and thereby improving the users satisfaction; (2) since formed in a oneness format, the chopstick manipulator is easily attached to and detached from chopsticks so that it can be served with regular chopsticks and selectively used by only those who need assistance in chopstick use; and (3) since the usable chopsticks on the market are provided in a limited range of thickness, a standard elasticity of the arms can readily hold more chopsticks, thereby improving usability and user satisfaction.

Although the present invention is briefly summarized, the full understanding of the invention can be obtained by the following drawings, detailed description and appended claims.

BRIEF DESCRIPTION OF DRAWINGS

These and other features, aspects and advantages of the present invention will become better understood with reference to the accompanying drawings, wherein.

DETAILED DESCRIPTION

Figure 1:
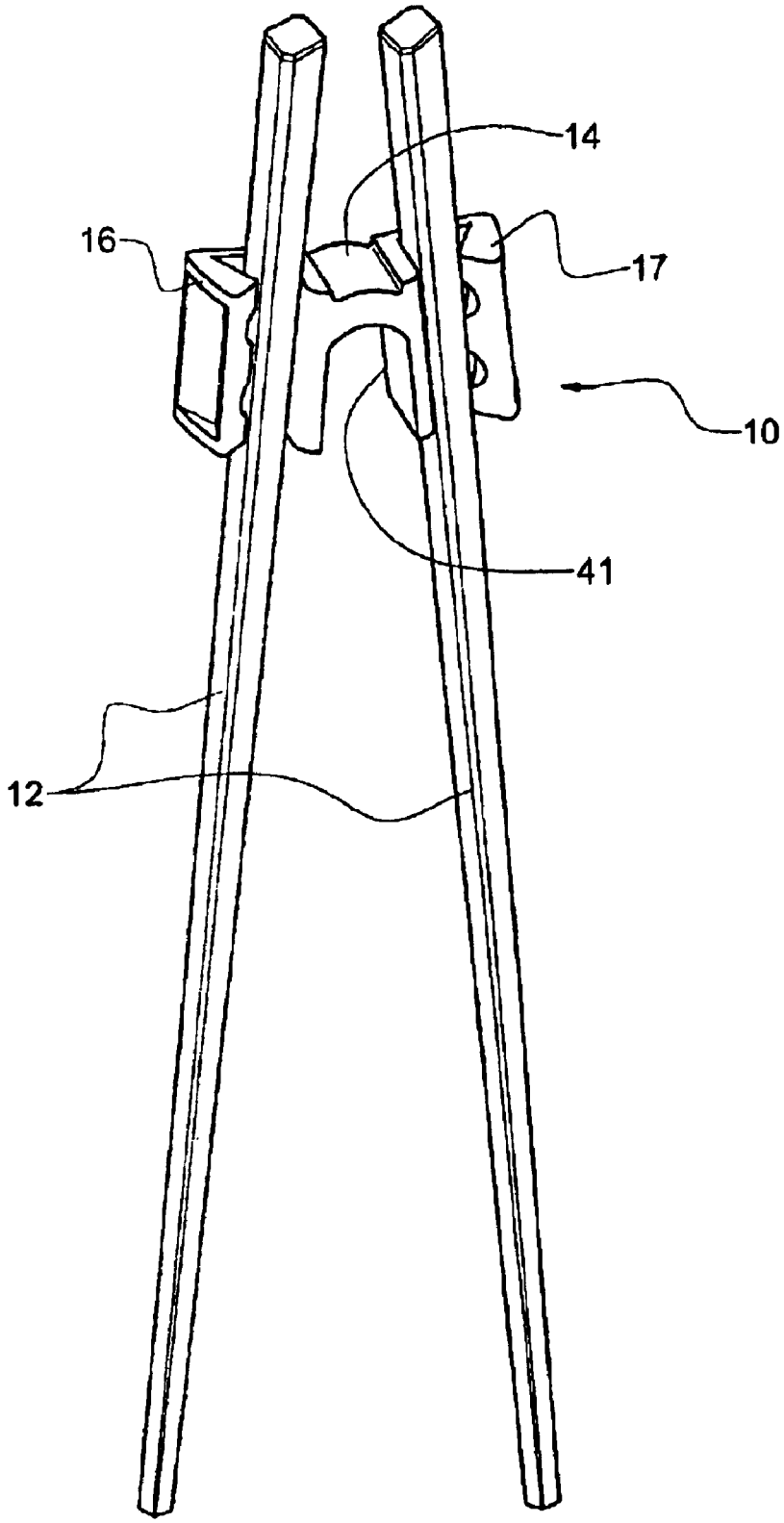
FIG. 1 is a perspective view showing a chopstick manipulator with chopsticks according to the present invention.
Figure 2:
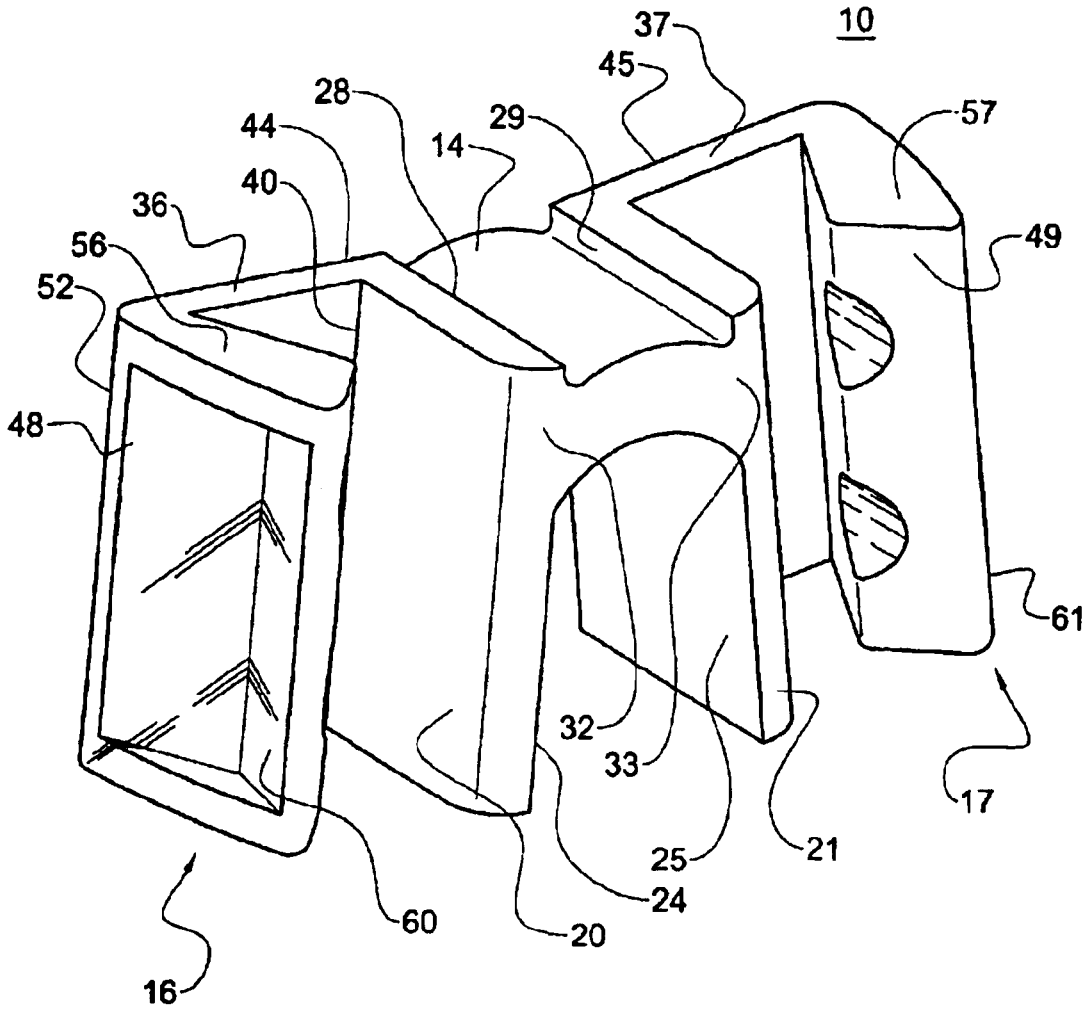
FIG. 2 is a perspective view showing the chopstick manipulator without chopsticks according to the present invention.
Figure 3:
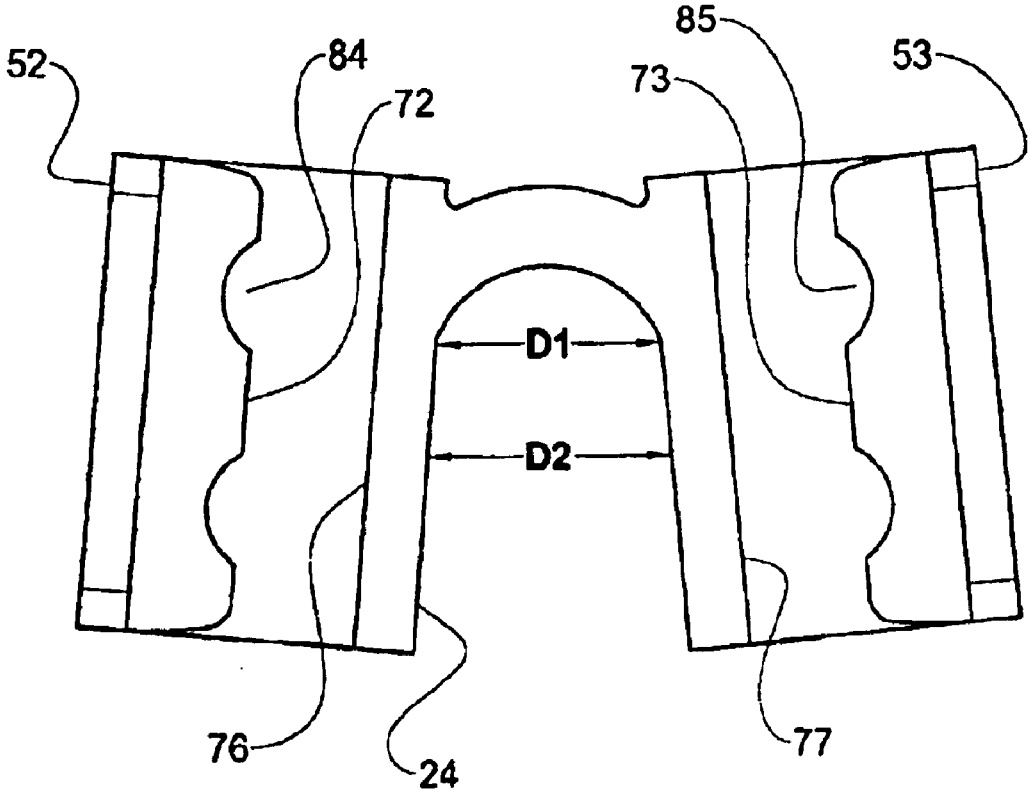
FIG. 3 is a front view of FIG. 2.
Figure 4:
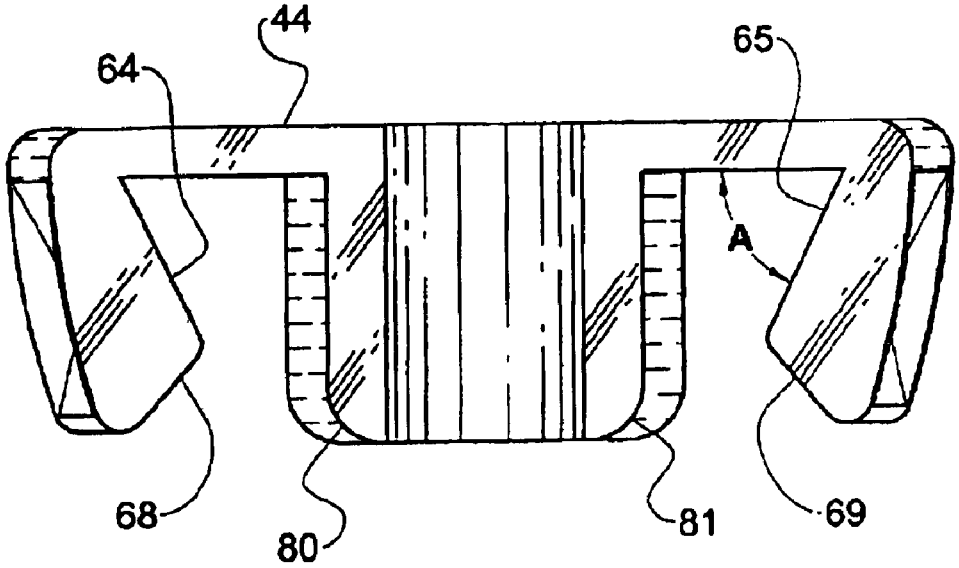
FIG. 4 is a top view of FIG. 2.

As shown in FIGS. 1, 2, 3 and 4, a chopstick manipulator 10 according to the present invention is provided to easily manipulate chopsticks 12 while eating. The chopstick manipulator 10 comprises a bridge 14, and first and second clamps 16, 17 being symmetric to each other. Each clamp 16, 17 includes an inner support 20, 21 being a plate and having an inner surface 24, 25. An upper half 28, 29 of the inner surface 24, 25 has a mid portion 32, 33. In this construction, the bridge 14 interconnects each mid portion 32, 33 of the inner surfaces 24, 25 of the inner supports 20, 21.

The clamps 16, 17 also include rear supports 36, 37 being another plate and extending from a rear end 40, 41 of the inner support 20, 21 so that about a right angle is formed by each outer surface 24, 44 of the inner and rear supports 20, 36. Further, the clamps 16, 17 includes a distal support 48, 49 extending substantially forward from an outer end 52, 53 of the rear support 36, 37 while forming a substantially prismatic shape 56, 57. The distal supports 56, 57 are each defined by an outer surface 60, 61, a rearward slant surface 64, 65 and a forward slant surface 68, 69 so that a prismatic ridge 72, 73 by the respective slant surfaces 64, 68 and 65, 69 approaches the outer surface 76, 77 of the inner support 20, 27. Meanwhile an angle A by the rear support 37 and the rearward slant surface 65 of the distal support 49 is preferably less than 90 degrees.

For a better performance, a distance between the inner supports 20, 27 is substantially incremental from top to down. For example, distance D1 near the bridge 14 is shorter than distance D2 farther down from the bridge 14. Preferably, the bridge 14 is substantially domed andupwardly waved to facilitate generation of elasticity when the chopsticks 72 are being manipulated. That is, when the chopsticks 12 fitted in the clamps 16, 17 are being approached to each other, a users finger work becomes stabilized and easily controlled in accordance with the elastic characteristics of the upwardly domed bridge 14.

Moreover, the bridge 14 has a thickness and a width, and preferably each inner support 20, 21 is less in thickness than the bridge 14. This construction further stabilizes the elastic manipulation of the chopsticks 12 without provision of additional elastic mechanism. The difference in thickness between the bridge 14 and each inner support 20, 21 enables elastic stability during the chopstick manipulation.

In order to accomplish a better mode, each rearward slant surface 64, 65 is provided to become substantially larger in size than each forward slant surface 68, 69. The forward slant surfaces 68, 69 serve to facilitate insertion of chopsticks 12 into each clamp 16, 17 while reserving prismatic characteristics of each distal support 56, 57. At the same time, the forward slant surfaces 68, 69 is formed smaller in size than the rearward slant surfaces 64, 65 so that each distal support 56, 57 elastically holds the chopsticks 12 in further security.

Since the angle A by each rear support 36, 37 and each distal support 56, 57 is formed substantially acute or less than ninety degrees, each distal support 56, 56 remains elastic while allowing each rearward slant surface 64, 65 to reliably hold the chopsticks 12 elastically inserted in the clamps 16, 17 without regard to chopstick types. For example, If shaped round, the chopsticks may be elastically supported by each rearward slant surface 64, 65, and if angled or squared in shaped, the chopsticks may be elastically supported by each prismatic ridge 72, 73 of the distal supports 56, 57 in prismatic shape.

Meanwhile, each front side end 80, 81 of the inner supports 20, 21 is outwardly tapered to further facilitate chopstick clamping by the clamps 16, 17. Eventually, the chopstick insertion is smoothly implemented due to the tapered front side ends 80, 81 and the forward slant surfaces 68, 69 of the distal supports 56, 57. Here, it is preferred that each prismatic ridge 72, 73 is linearly straight or parallel to the corresponding inner support 20, 21. In this construction, at lease one indentation 84, 85 is formed in and along each prismatic ridge 72, 73 to decrease friction between the chopsticks and the prismatic ridges 72, 73.

For the best performance, the chopstick manipulator 10 is formed of a single material, preferably, a plastic material and molded in oneness.

As discussed above, an advantage of the present invention is that the chopstick holding of the manipulator 10 is implemented by clamps 16, 17 such that chopsticks 12 become inserted by a sidewise elastic push of the chopsticks into the clamps 16, 17, for example, enabling the user to substantially synchronize the chopstick use with those good at chopstick manipulation and thereby improving the users satisfaction.

Further, since formed in a oneness format, the chopstick manipulator 10 is easily attached to and detached from chopsticks 12 so that it can be served with regular chopsticks and selectively used by only those who need assistance in chopstick use. In addition, since the usable chopsticks on the market are provided in a limited range of thickness, a standardized elasticity of the arms can readily hold more chopsticks, thereby improving usability and user satisfaction.

Although the invention has been described in considerable detail, other versions are possible by converting the aforementioned construction. Therefore, the scope of the invention shall not be limited by the specification specified above and the appended claims.

What is claimed is:

1. A chopstick manipulator comprising;

a) a bridge; and b) first and second clamps being symmetric to each other, wherein said each clamp includes:

(i) an inner support being a plate, wherein the bridge interconnects each inner surface of the inner supports;

(ii) a rear support being another plate and extending from a rear end of the inner support so that about a right angle is formed by each outer surface of the inner and rear supports; and (iii) a distal support extending substantially forward from an outer end of the rear support while forming a substantially prismatic shape, wherein the distal support is defined by an outer surface, a rearward slant surface and a forward slant surface so that a prismatic ridge by the respective slant surfaces approaches the outer surface of the inner support, wherein at least one indentation is formed in and along said each prismatic ridge, wherein an angle by the rear support and the rearward slant surface of the distal support is less than 90 degrees.

2. The chopstick manipulator of claim 1 wherein the bridge is substantially domed to become upwardly waved.

3. The chopstick manipulator of claim 2 wherein the bridge has a thickness and a width, wherein said each inner support is less in thickness than the bridge.

4. The chopstick manipulator of claim 1 wherein the rearward slant surface is substantially larger in size than the forward slant surface.

5. The chopstick manipulator of claim 1 wherein each front side end of the inner supports is outwardly tapered to facilitate chopstick clamping by the clamps.

6. The chopstick manipulator of claim 1 wherein said each prismatic ridge is linearly straight.

7. The chopstick manipulator of claim 1 wherein said each prismatic ridge is parallel to the corresponding inner support.

8. A chopstick manipulator comprising:

a) a bridge; and b) first and second clumps being symmetric to each other, wherein said each clamp includes:

(i) an inner support being a plate and having an inner surface, wherein an upper half of the inner surface has a mid portion, wherein the bridge interconnects said each mid portion of the inner surfaces of the inner supports;

(ii) a rear support being another plate and extending from a rear end of the inner support so that about a right angle is formed by each outer surface of the inner and rear supports; and (iii) a distal support extending substantially forward from an outer end of the rear support while forming a substantially prismatic shape, wherein the distal support is defined by an outer surface, a rearward slant surface and a forward slant surface so that a prismatic ridge by the respective slant surfaces approaches the outer surface of the inner support, wherein at least one indentation is formed in and along said each prismatic ridge, wherein an angle by the rear support and the rearward slant surface of the distal support is less than 90 degrees.

9. The chopstick manipulator of claim 8 wherein the bridge is substantially darned and upwardly waved.

10. The chopstick manipulator of claim 9 wherein the bridge has a thickness and a width, wherein said each inner support is less in thickness than the bridge.

11. The chopstick manipulator of claim 8 wherein the rearward slant surface is substantially larger in size than the forward slant surface.

12. The chopstick manipulator of claim 8 wherein each front side end of the inner supports is outwardly tapered to facilitate chopstick clamping by the clamps.

13. The chopstick manipulator of claim 8 wherein said each prismatic ridge is linearly straight.

14. The chopstick manipulator of claim 8 wherein said each prismatic ridge is parallel to the corresponding inner support.

* * * * *